US010180242B2

(12) United States Patent
Schreiber et al.

(10) Patent No.: US 10,180,242 B2
(45) Date of Patent: Jan. 15, 2019

(54) DECORATIVE LIGHT CLIP FOR GUTTERS AND SHINGLES

(71) Applicant: Adams Mfg. Corp., Portersville, PA (US)

(72) Inventors: Robert G. Schreiber, Prospect, PA (US); William E. Adams, IV, Harmony, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 15/647,832

(22) Filed: Jul. 12, 2017

(65) Prior Publication Data

US 2018/0017240 A1 Jan. 18, 2018

Related U.S. Application Data

(60) Provisional application No. 62/361,584, filed on Jul. 13, 2016.

(51) Int. Cl.

*F21V 21/088* (2006.01)
*F21S 4/10* (2016.01)
*F21W 121/00* (2006.01)

(52) U.S. Cl.

CPC ..... *F21V 21/088* (2013.01); *F21S 4/10* (2016.01); *F21W 2121/004* (2013.01)

(58) Field of Classification Search

CPC ..... F21V 21/08; F21V 21/088; F21V 21/016; F21V 21/832; F21S 4/10; F21W 2121/004; F21W 2121/04

See application file for complete search history.

(56) References Cited

U.S. PATENT DOCUMENTS

D233,312 S 10/1974 Lock
5,566,058 A 10/1996 Protz, Jr.
5,607,230 A * 3/1997 Protz, Jr. ..... F21V 21/08 248/229.16

(Continued)

FOREIGN PATENT DOCUMENTS

MX 022893-0001 1/2008

OTHER PUBLICATIONS

Amazon.com: Dyno Seasonal Solutions St. Nick's Choice All-in-1 Universal Gutter Shingle Clip, review date Nov. 18, 2013, https://www//amazon.com/Dyno-Seasonal-Solutions-Universal-Shingle/dp/B003828GJY/ref=sr_1_24?ie=UTF8&qid=1494451246&sr=8-24&keywords=gutter+light+clips, site visited May 10, 2017.

(Continued)

*Primary Examiner* — Hargobind S Sawhney
(74) *Attorney, Agent, or Firm* — Buchanan Ingersoll & Rooney PC

(57) ABSTRACT

A clip for holding decorative lights has an arm with a hook at one end, a leg and middle portion between the arm and the leg. The hook and leg together define a space between them in which will receive a roofing shingle or a portion of a gutter. A second hook may be attached to the middle portion and sized to receive a rope light. There may also be a light holding portion attached by a hinge to the corner formed where he arm meets the middle portion. There is a first locking tab attached to the arm and a second locking tab is attached to the middle portion. A first retainer tab and a second retainer tab on opposite sides of the light holding portion are configured and positioned to engage one of the pair of locking tabs.

23 Claims, 7 Drawing Sheets

(56) References Cited

U.S. PATENT DOCUMENTS

| | | | | | |
|---|---|---|---|---|---|
| 5,609,415 | A | | 3/1997 | Protz, Jr. | |
| 5,772,166 | A | | 6/1998 | Adams | |
| D414,291 | S | * | 9/1999 | Gary | D26/138 |
| D422,203 | S | | 4/2000 | Gary et al. | |
| D424,418 | S | | 5/2000 | Gary et al. | |
| D427,510 | S | * | 7/2000 | Gary | D26/138 |
| D460,912 | S | | 7/2002 | Gary et al. | |
| 6,513,772 | B2 | | 2/2003 | Gary et al. | |
| 6,644,836 | B1 | | 11/2003 | Adams | |
| D494,849 | S | * | 8/2004 | Jones | D8/395 |
| D510,018 | S | | 9/2005 | Tognolini | |
| D537,330 | S | | 2/2007 | Cox et al. | |
| D538,636 | S | | 3/2007 | Jackson et al. | |
| D671,826 | S | | 12/2012 | Adams, IV et al. | |
| D675,087 | S | | 1/2013 | Gary et al. | |
| D675,509 | S | | 2/2013 | Gary et al. | |
| D675,510 | S | | 2/2013 | Gary et al. | |
| D696,105 | S | | 12/2013 | DeVilliers et al. | |
| 8,888,337 | B2 | | 11/2014 | Adams, IV et al. | |
| D756,764 | S | | 5/2016 | Limber | |
| D799,314 | S | * | 10/2017 | Adams, IV | D8/395 |
| 2005/0017144 | A1 | | 1/2005 | Jackson et al. | |
| 2013/0148366 | A1 | | 6/2013 | Adams, IV et al. | |

OTHER PUBLICATIONS

100 Pack of Omni Clips for All type of Christmas Lights, Noveltylights.com website 2017, http://www.noveltylights.com/omniclip-39414, site visited May 11, 2017.

* cited by examiner

DECORATIVE LIGHT CLIP FOR GUTTERS AND SHINGLES

CROSS-REFERENCE TO RELATED APPLICATIONS

This application claims the benefit of U.S. Provisional Application Ser. No. 62/361,584 filed Jul. 13, 2016.

FIELD OF THE INVENTION

The invention relates to mounting clips for attaching decorative lights to various structures and for holding other objects that contain a generally cylindrical body or body portion.

DESCRIPTION OF THE PRIOR ART

The use of lights for decorating the exterior of a house is well known. Decorative lights typically consist of a large number of light sockets being wired together with light bulbs positioned in the light sockets. The "string" of lights is then attached to the face of a building. The "string" of lights can be mounted by retaining either the light socket or the wire. Rope lights and icicle lights are other types of decorative lights. Rope lights consist of a string of miniature lights inside a transparent or translucent tube. Icicle lights have a series of short strands of lights that when hung extend downward from a horizontal cord.

Over the years a variety of removable plastic clips or holders have been developed for attaching decorative lights to gutters, shingles and siding. The object of these clips and holders is to display the lights so that they can easily be seen. They must not be adversely affected by cold temperatures and should be able to hold the lights during high winds which commonly accompany winter storms. These clips rely on a user to apply manual force to lock the clip onto an existing profile on the house, such as shingles, gutters, or shutters. As a result, these clips are typically only able to connect to a limited number of structures on a house that may resemble the existing profile relied upon by the clip. Moreover, such clips are often difficult to remove from the house. In fact, when a user does manage to remove such clips, a user may damage the structure to which the clip is attached.

For example, U.S. Pat. No. 5,609,415 to Protz, Jr. discloses a two piece light clip for attachment to shingles or gutters that permit lights to be angularly oriented with respect to the roof line. The two part clip comprises an attaching body that attaches to a gutter or shingle and another body that attaches the light to the attaching body. Protz teaches that the attaching body of his clip should have no less than three different contact areas between a gutter and the clip. The clip disclosed by Protz, however, does not solve the problems associated with removing the clip. For instance, Protz's clip requires the removal of two separate bodies. Moreover, the attaching body, similar to the clips discussed above, lock onto existing profiles of the shingles or gutters. Consequently, different attaching bodies are needed for different gutter or shingle designs. Further, these clips are difficult to remove without damaging the shingle or gutter part to which the clip is attached.

U.S. Pat. No. 8,888,337 B2 discloses a clip for holding decorative lights that has a clamp portion, a light holding portion and a bridge. The bridge connects the clamp portion to the light holding portion such that the clamp portion, the light holding portion and the bridge lie in a common plane and are formed as a unitary plastic body. The clamp portion has a leg tapered at one end and a second end which is connected to a bridge portion that holds the bridge. The bridge is also connected to a clamping arm forming a corner which has an opening. A hook is provided on the end of the arm which defines a space of sufficient size to receive a rope light. The arm and the hook are sized and configured so that the hook will be adjacent the leg and the hook and leg together define a space between them in which a roofing shingle can be inserted such that the leg and the hook will engage opposite surfaces of the roofing shingle. The light holding portion can be broken away from the clamp portion. Then the two pieces can be connected together by placing a stake on the light holding portion into the opening in the clamp portion.

U.S. Pat. No. 5,772,166 discloses a mounting clip which has a mounting for attachment to a shingle or siding and a light holder portion which holds the socket of a decorative light. Various configurations of light holders are disclosed, ranging from U-shapes, to C-shapes which define a circular opening smaller than the socket of a decorative light. Yet none of the various configurations is suitable for mounting all types of decorative lights to shingles or gutters so that the lights are readily visible.

Several plastic light holders known in the art are configured such that the light holder will fit under a shingle and when rotated ninety degrees will fit onto a gutter. Yet, many of these clips hold the bulb in the same orientation relative to the clip such that the light bulb will be vertical when the clip is attached to a shingle and the bulb will be horizontal when the light clip is attached to a gutter or vice versa. It is preferred that the light bulb always be in the vertical position, although there are some installations where the light bulb would always want to be held vertically such as with some smaller bulbs or with cheaper LED lights were the diodes are low in the socket.

Many of the known decorative light holders have a hook that is configured to hold a rope light. When the light holder is attached to a gutter the rope light will be held below the lip of the gutter, and when the light holder is attached to a shingle the rope light will be above the edge of the shingles. This hook could be used to hang icicle lights when attached to a gutter but is not suitable for holding icicle lights when attached to shingles.

Consequently, there remains a need to provide a reusable clip or holder for decorative lights that is capable of attaching decorative light strings which have any size light bulb, as well as rope lights and icicle lights onto shingles or gutters of a house that is easy for a user to attach to and remove from the house. The clip should be capable of always holding the light bulb in a similar orientation across both substrates of shingles or gutters. This applies on any structure, but, especially on homes where the front view includes both a gutter and a shingle edge, maintaining the same orientation creates a nicer display.

SUMMARY OF THE INVENTION

We provide a clip for holding decorative lights on a gutter and for holding decorative lights on shingles which has a leg tapered at one end and having a second end. a middle portion having a first end and a second end, the second end of the middle portion connected to the second end of the leg such that the middle portion and the leg are substantially perpendicular to one another and an arm having a first end connected to the first end of the middle portion at a corner. The arm adjacent the middle portion and the middle portion are substantially perpendicular to one another. The arm has a second end with a hook at the second end. The hook has a distal end and defines a space of sufficient size to receive a rope light. The arm and the hook are sized and configured so that the hook will be adjacent the leg and the hook and leg together define a space between them in which a roofing shingle can be inserted such that the leg and the hook will engage opposite surfaces of the roofing shingle and to define an opening sized and configured to receive a portion of a gutter. A second hook is attached to the middle and sized to receive a rope light. A light holding portion having a U-shaped body is attached to the corner.

The light holding portion is preferably attached to the corner by a living hinge. We also prefer to provide a pair of locking tabs attached adjacent the corner such that a substantially right angle is formed between the pair of locking tabs. A first retainer tab attached to the light holding portion and is being configured and positioned to engage one of the pair of locking tabs when the light holding portion is in a first position. A second retainer tab is attached to the light holding portion and is configured and positioned to engage another of the pair of locking tabs when the light holding portion is in a second position.

We also prefer to provide wings that extend outward from the corner. The wings provide stability for the clip when the clip is on a gutter, such that vertically held bulbs are prevented from tilting to either side.

DESCRIPTION OF THE PREFERRED EMBODIMENTS

Figure 1:
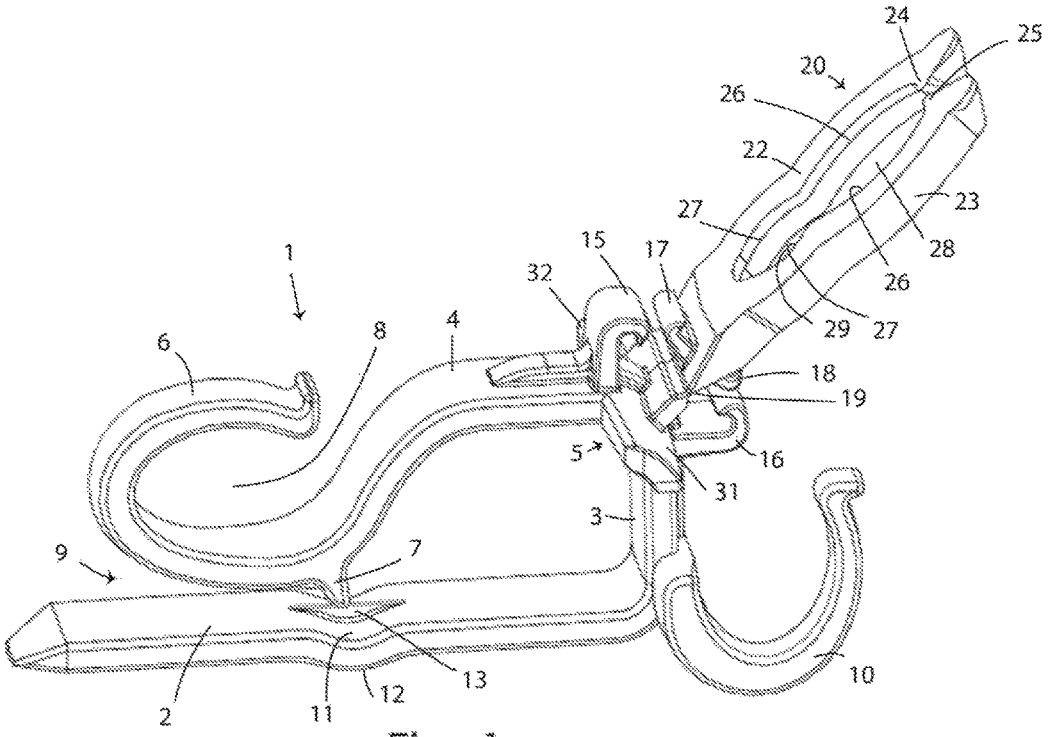
FIG. 1 is a perspective view showing one side of a present preferred embodiment our clip for holding decorative lights on a gutter and for holding decorative lights on shingles.
Figure 2:
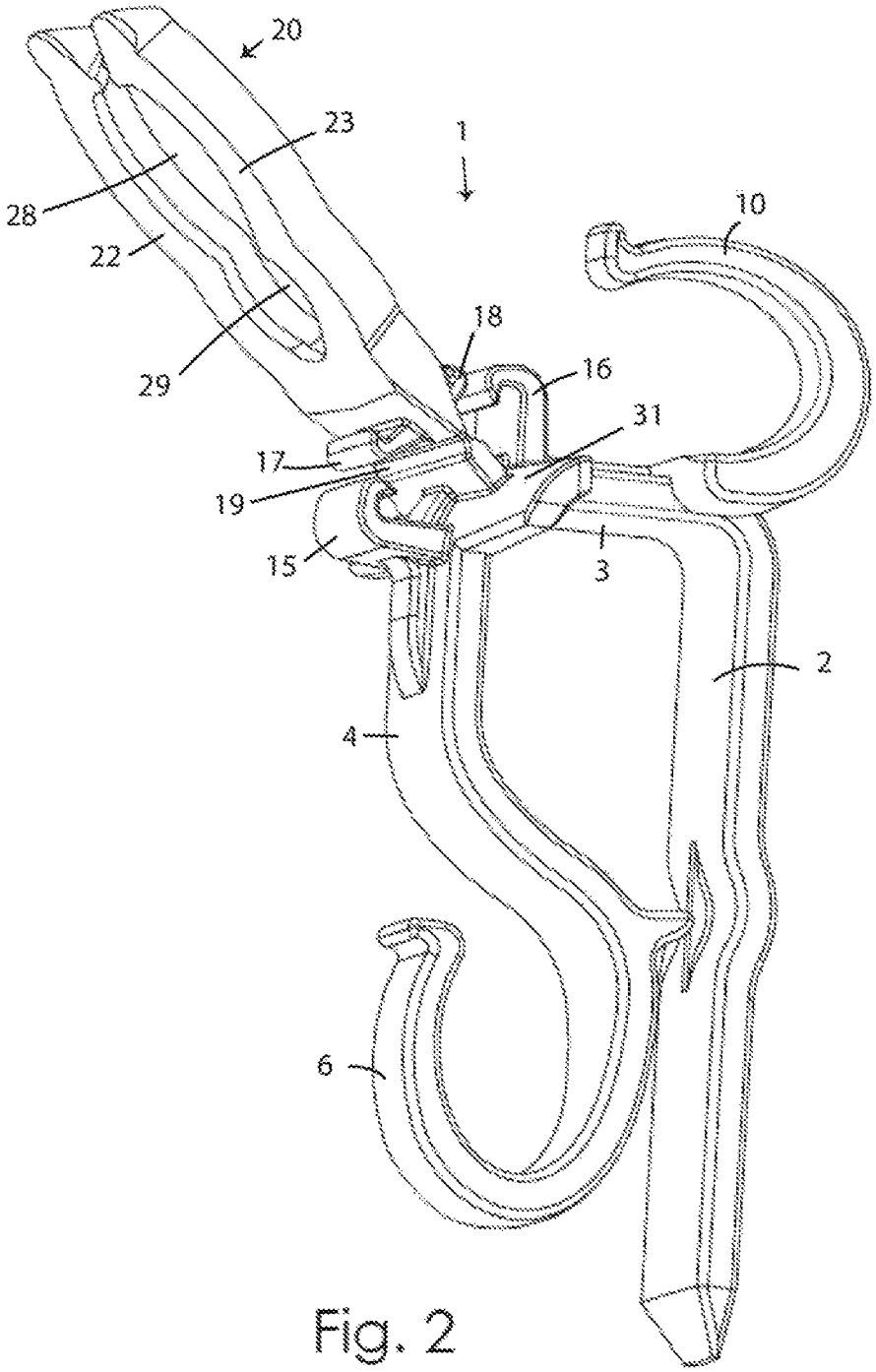
FIG. 2 is another perspective view of the clip shown in FIG. 1.

Referring to FIGS. 1 through 4 we provide a clip 1 for holding decorative lights on a gutter and for holding decorative lights on shingles which has a leg 2 tapered at one end and having a second end, a middle portion 3 having a first end and a second end, the second end of the middle portion connected to the second end of the leg 2 such that the middle portion and the leg are substantially perpendicular to one another. An arm 4 has a first end connected to the first end of the middle portion at a corner 5. The arm 4 and the middle portion 3 are substantially perpendicular to one another. The opposite end of the arm 4 is curved to create a hook 6 having an opening 8 which is sized to receive a rope light or the cord portion of a string of decorative lights or icicle lights. There is a space 9 between the hook 6 and the leg 2 into which a roofing shingle can be inserted such that the leg and the hook will engage opposite surfaces of the roofing shingle. This space can also receive a portion of a gutter. A projection 7 is provided on the arm near the hook 8 such that the projection 7 is opposite the leg 2. We prefer that the leg 2 have a concave area or recess 11 on one side of the leg and a convex area or bump 12 on the opposite side of the leg. We prefer to provide a rib 13 in the recess 11. The projection 7 and rib 13 enables the arm 4 and the leg 2 to clamp and securely hold a shingle between them. The bump 12 increases the friction of the leg and the shingle below it when the clip is attached to a shingle. When the clip 1 is being placed on a gutter, the edge of the gutter can move into space 9 as the clip 1 is being pulled downward. A second hook 10 is attached to the middle portion and sized to receive a rope light. The second hook 10 is preferably attached to one side of the middle portion 3.

A light holding portion 20 having a U-shaped body is attached to the corner. The light holding portion, or bulb gripper, has a generally U-shaped body comprised of a first arm 22 and a second arm 23. Each arm has a pair of concave arcs or recesses 26, 27 which define two openings 28, 29 of different size allowing the arms 22, 23 to grip different size decorative lights. The larger opening 28 can hold a C-7 or C-9 decorative light. The smaller opening 29 can hold a mini light. We prefer to provide a tooth or projection 24, 25 on each arm 22, 23 which engages a bulb socket to prevent the socket from turning relative to the clip while being held.

Many homeowners prefer to mount their lights so that the bulb is oriented vertically relative to the ground. The present clip is capable of mounting lights to both a gutter and to shingles in manner to maintain the lights in a vertical orientation. The connection 19 between the corner and the U-shaped body which holds the decorative light preferably is molded to act as a living hinge. A first locking tab 15 is provided on the arm 4 near the corner 5. A second locking tab 16 is provided on the middle section 3 near the corner 5. The first locking tab 15 is positioned to receive retaining tab 17 on the bulb gripper 20 and hold the bulb gripper in the position shown in FIG. 3. The second locking tab 16 is positioned to receive a second retaining tab 18 on the opposite face of the bulb gripper 20 and hold the bulb gripper in the position shown in FIG. 4. A center line through the first locking tab will intersect a center line through the second locking at a substantially right angle A as shown in FIG. 3.

Figure 3:
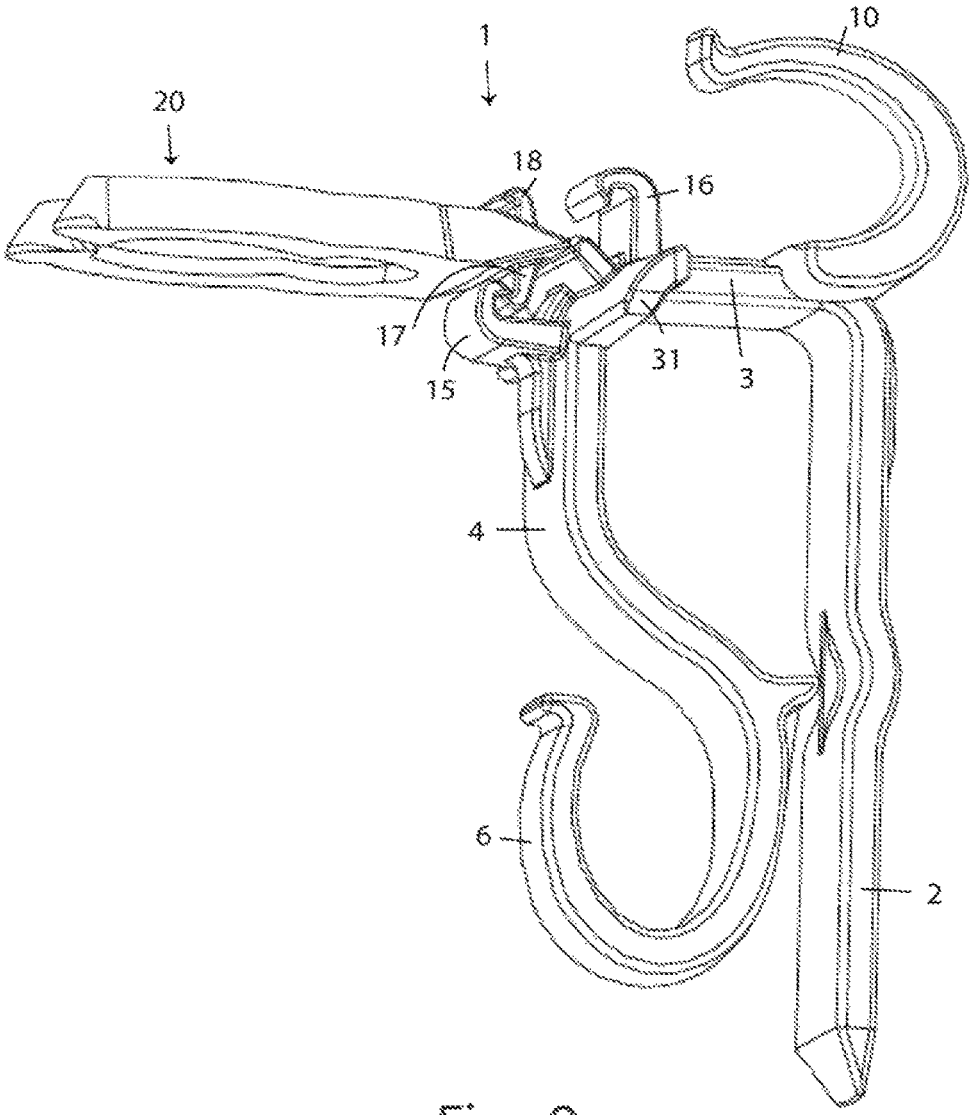
FIG. 3 is a perspective view of the clip shown in FIGS. 1 and 2 with the bulb gripper positioned for holding a decorative light when the clip is on a gutter.

The user may move the light holding portion or bulb gripper 20 to the position shown in FIG. 3. In that position the first retaining tab 17 will have engaged the first locking tab 15 to hold the bulb gripper 20 in place. Or, the user may move the bulb gripper 20 to the position shown in FIG. 4. In that position the second retaining tab 18 will have engaged the second locking tab 16 to hold the bulb gripper 20 in place. The first position shown in FIG. 3 is particularly suitable for attaching lights to the gutter. The leg fits into the gutter while the clamping arm fits around the front of the gutter. The bulb gripper 20 is then oriented horizontally such that the light bulb is vertically oriented relative to the ground.

Figure 4:
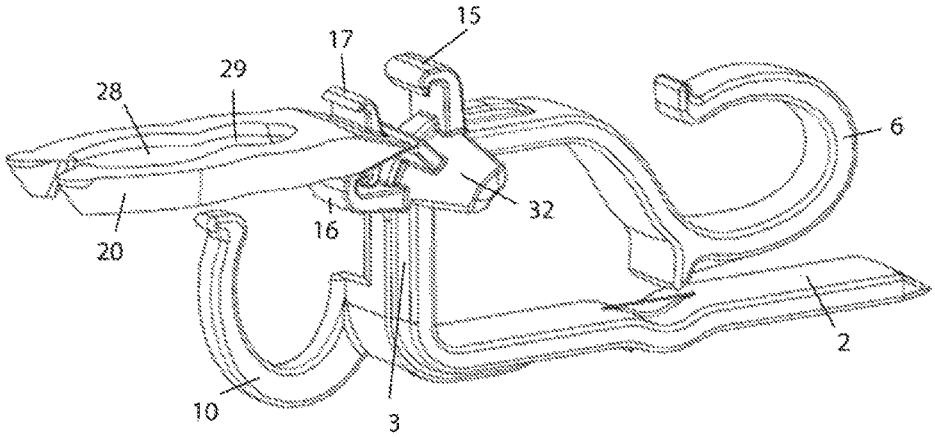
FIG. 4 is another perspective view of the clip shown in FIGS. 1, 2 and 3 with the bulb gripper positioned for holding a decorative light when the clip is attached to a shingle.
Figure 5:
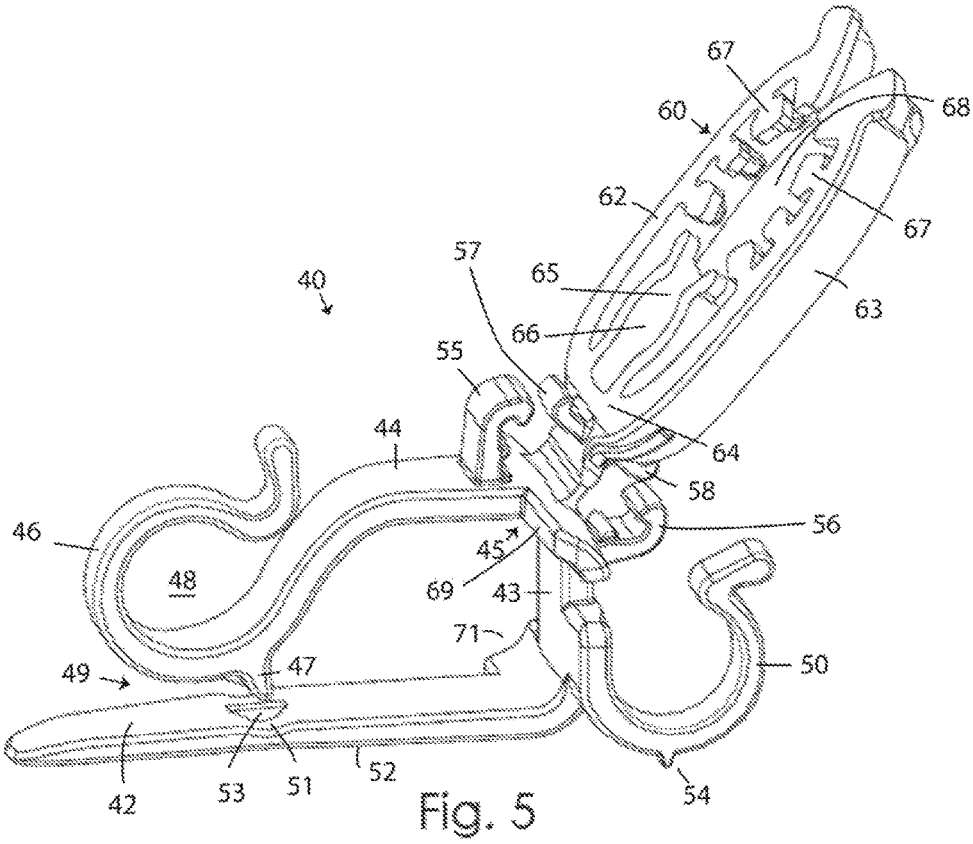
FIG. 5 is a perspective view showing one side of a second present preferred embodiment our clip for holding decorative lights on a gutter and for holding decorative lights on shingles.
Figure 6:
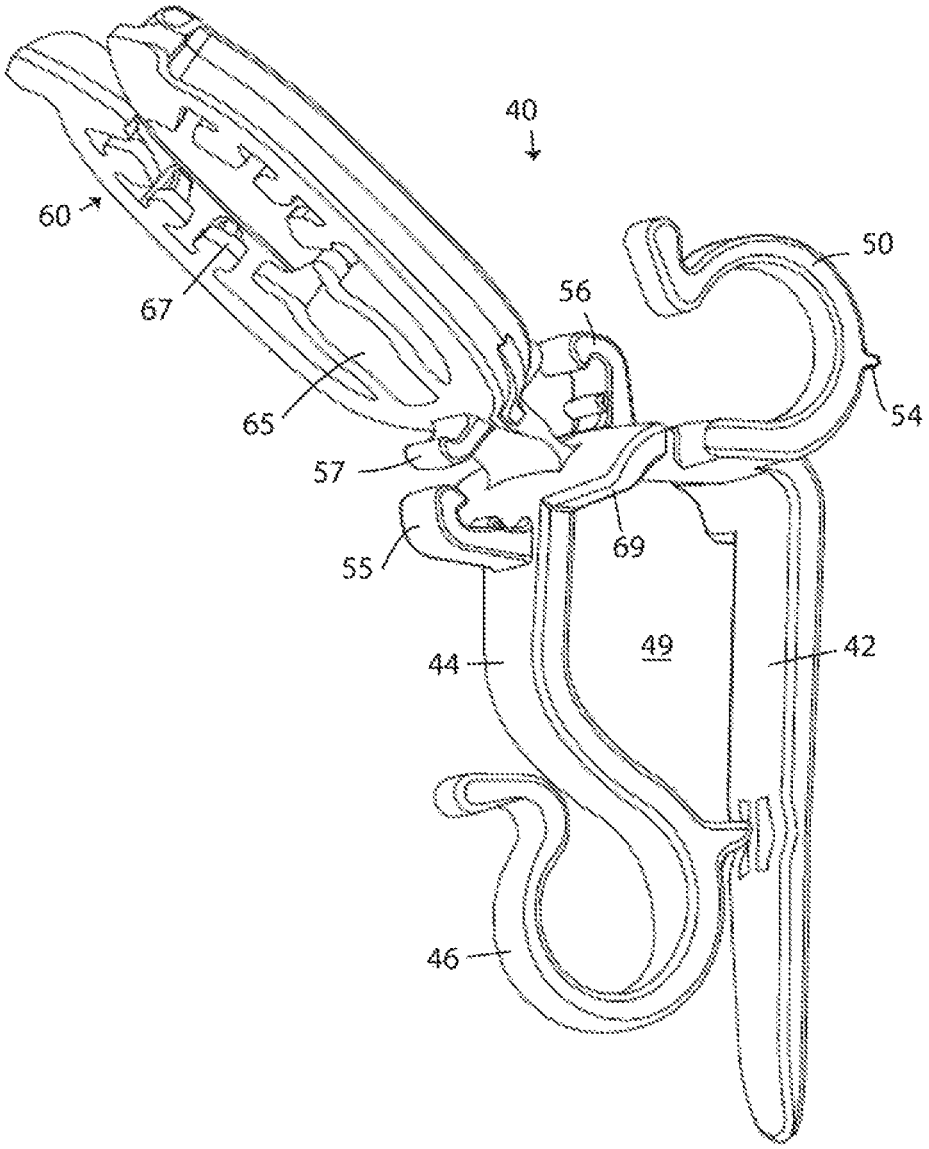
FIG. 6 is another perspective view of the clip shown in FIG. 5.
Figure 7:
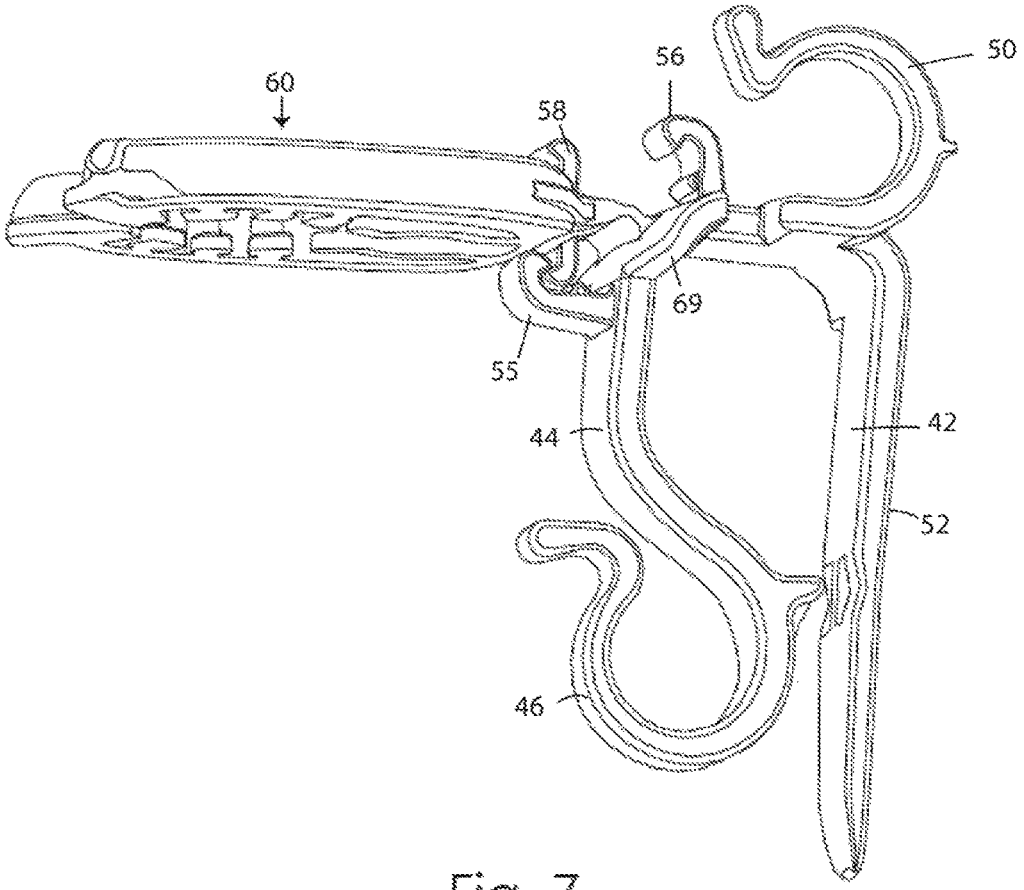
FIG. 7 is a perspective view of the clip shown in FIGS. 5 and 6 with the bulb gripper positioned for holding a decorative light when the clip is on a gutter.
Figure 8:
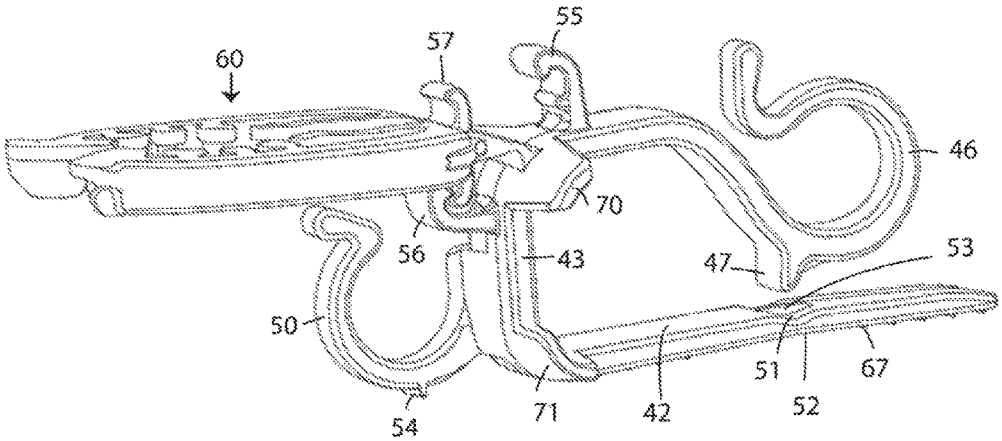
FIG. 8 is another perspective view of the clip shown in FIGS. 5, 6 and 7 with the bulb gripper positioned for holding a decorative light when the clip is attached to a shingle.

In the second configuration shown in FIG. 4 the bulb gripper 20 has been rotated nearly 90° from the position shown in FIG. 3. When the clip 1 is mounted on shingles the bulb gripper 20 will be horizontal and the decorative light will be held in a vertical orientation relative to the ground or when used on gable ends, the lights will be held at the angle of the gable ends, yet the bulbs will still be mostly upright and fully visible. Furthermore, rope lights can be held in the second hook 10 adjacent the leg 2 and be positioned outward from the edge of the shingles. This hook 10 is offset from a centerline through the middle portion 3 so that the hook 10 will not interfere with placement and retention of the socket of a decorative light that is being held by the bulb holder 20 when in the position shown in FIG. 4. We prefer to provide a pair of wings 31 and 32 to provide stability against lateral movement when the clip is on a gutter as well as to resist rotation or tilting. One wing extends from each side of the corner.

A second present preferred embodiment of our clip for holding decorative lights on a gutter and for holding decorative lights on shingles is shown in FIGS. 5 through 8. We provide a clip 40 has a leg 42 tapered at one end and having a second end, a middle portion 43 having a first end and a second end, the second end of the middle portion connected to the second end of the leg 42 such that the middle portion and the leg are substantially perpendicular to one another. We prefer that the exterior surface 52 the leg 42 is slightly concave between the tapered end and the second end to allow the leg to sit fully flush when used on intra-roof shingles. A series of transverse ribs 72 shown in FIG. 8 may be provided on the exterior surface of the leg to increase the friction between the clip and the shingle below the leg when the clip is attached to a shingle. An arm 44 has a first end connected to the first end of the middle portion at a corner 45. The arm 44 and the middle portion 43 are substantially perpendicular to one another. The opposite end of the arm 44 is curved to create a hook 46 having an opening 48 which is sized to receive a rope light or the cord portion of a string of decorative lights or icicle lights. A projection 47 is provided on the arm near the hook 48 such that the projection 47 is opposite the leg 42. We prefer to provide a concave area or recess 51 on one side of the leg 42 opposite projection 47. We prefer to provide a rib 53 in the recess. The projection 47 and rib 53 enable the arm 44 and the leg 42 to clamp and securely hold a shingle between them. When the clip 40 is being placed on a gutter, the edge of the gutter can move into space 49 as the clip is being pulled downward. A second hook 50 is attached to the middle portion and sized to receive a rope light. A projection 54 may be provided on the second hook 50 to engage a lower shingle and enhance the grip with which the clip is held in place. This is for when clips are used on intra-roof shingles rather than on roof-edge shingles.

A light holding portion or bulb gripper 60 is attached to the corner 55. The light holding portion 60 has a generally U-shaped body 61 comprised of a first arm 62, a second arm 63 and a base 64. A U-shaped holder 65 for holding a mini-light is provided at the base of arms 62 and 63. This holder 65 has an opening 66 that is sized to receive mini-light. Each arm 62, 63 has a set of teeth 67 for gripping the socket of a C-7 or C-9 decorative light bulb or of newer diameter sizes and styles of bulbs such as LED C-12s. The teeth define a larger opening 58 which enables the bulb gripper 50 to hold a C-7 or C-9 decorative light. The teeth 67 on the arms 62, 63 engage the neck or indent formed by the top of the socket and the base of the bulb. The teeth gripping into the neck on a light prevents the socket from turning relative to the clip while being held, keeping lights precisely positioned.

As in the first embodiment a first locking tab 55 is provided on the arm 44 near the corner 45 and a second locking tab 56 is provided on the middle section 43 near the corner 45. The first locking tab 55 is positioned to receive retaining tab 57 on the bulb gripper 20 and hold the bulb gripper in the position shown in FIG. 7. The second locking tab 56 is positioned to receive a second retaining tab 58 on the opposite face of the bulb gripper 40 and hold the bulb gripper in the position shown in FIG. 8. We prefer to provide a pair of wings 69 and 70 to provide stability against a tilting or a lateral movement when the clip is on a gutter. One wing extends from each side of the corner 45. We also prefer to provide a stabilizer 71 that extends from the middle portion 43 opposite the second hook 50.

The clip 1, 40 is preferably made as a unitary molded plastic body which is molded as the shape shown in FIGS. 1, 2, 5 and 6. The clip can be made from polypropylene or other plastic. The light clip is packaged in the as molded condition shown in FIGS. 1 and 2.

The bulb gripper 20, 60 and associated locking tabs and retaining tabs could be removed from the embodiments shown in the drawings to provide a clip that can hold strings of decorative lights by the cord rather than by the light socket as well as hold rope lights and icicle lights. Having the hook 10, 50 attached to one side of the middle portion 3, 43 provides a flat surface on the middle portion that can be used to push the clip onto a shingle.

While we have shown and described certain present preferred embodiments of our clip for holding decorative lights on a gutter and for holding decorative lights on shingles it should be understood that our invention is not limited thereto and may be embodied within the scope of the following claims.

We claim:

1. A clip for holding decorative lights on a gutter and for holding decorative lights on shingles comprised of:

a leg tapered at one end and having a second end;

a middle portion having a first end and a second end, the second end of the middle portion connected to the second end of the leg such that the middle portion and the leg are substantially perpendicular to one another;

an arm having a first end connected to the first end of the middle portion at a corner such that a portion of the arm adjacent the middle portion and the middle portion are substantially perpendicular to one another, the arm having a second end with a hook at the second end, the hook having a distal end and defining a space of sufficient size to receive a rope light; wherein the arm and the hook are sized and configured so that the hook will be adjacent the leg and the hook and leg together define a space between them in which a roofing shingle can be inserted such that the leg and the hook will engage opposite surfaces of the roofing shingle;

a second hook attached to the middle portion and sized to receive a rope light; and a light holding portion comprising a U-shaped body and attached to the corner.

2. The clip for holding decorative lights of claim 1 also comprising:

a first locking tab and a second locking tab, the first locking tab attached to the arm adjacent the corner and the second locking tab attached to the middle portion adjacent the corner such that a center line through the first locking tab will intersect a center line through the second locking at a substantially right angle;

a first retainer tab attached to the light holding portion and being configured and positioned to engage the first locking tab when the light holding portion is in a first position;

a second retainer tab attached to the light holding portion and being configured and positioned to engage the second locking tab when the light holding portion is in a second position; and a hinge connecting the light holding portion to the corner.

3. The clip for holding decorative lights of claim 1 wherein the leg has a concave portion opposite the hook and also comprising a projection on the hook that extends toward the concave portion of the leg.

4. The clip for holding decorative lights of claim 1 wherein the clamp portion, the light holding portion and the middle are polypropylene.

5. The clip for holding decorative lights of claim 1 wherein the U-shaped body has an inner surface having two pairs of arcs, each pair of arcs defining an opening sized to receive a decorative light.

6. The clip for holding decorative lights of claim 5 also comprising at least one tooth on the inner surface of the U-shaped body.

7. The clip for holding decorative lights of claim 1 also comprising a pair of wings, one wing extending from each side of the corner.

8. The clip for holding decorative lights of claim 1 wherein the second hook is offset from a center line through the middle portion.

9. The clip for holding decorative lights of claim 1 wherein the U-shaped body has an inner surface having opposite sides and a base that extends between the sides, the sides defining an opening sized to receive a decorative light and further comprising a U-shaped holder sized to hold a mini-light.

10. The clip for holding decorative lights of claim 9 further comprising a plurality of teeth on the inner surface, the teeth defining an opening sized to receive and grip a socket of a C-7 decorative light bulb, a socket of a C-9 decorative light bulb or a socket of an LED decorative light bulb.

11. The clip for holding decorative lights of claim 1 wherein the leg has a concave exterior surface between the tapered end and the second end.

12. The clip for holding decorative lights of claim 1 wherein the middle portion has a first side and a second side opposite the first side, the second hook being attached to the middle portion adjacent the first side and further comprising a stabilizer attached to and extending from the second side.

13. A clip for holding decorative lights on a gutter and for holding decorative lights on shingles comprised of:

a leg tapered at one end and having a second end;

a middle portion having a first end and a second end, the second end of the middle portion connected to the second end of the leg such that the middle portion and the leg are substantially perpendicular to one another;

an arm having a first end connected to the first end of the middle portion at a corner such that a portion of the arm adjacent the middle portion and the middle portion are substantially perpendicular to one another, the arm having a second end with a hook at the second end, the hook having a distal end and defining a space of sufficient size to receive a rope light; wherein the arm and the hook are sized and configured so that the hook will be adjacent the leg and the hook and leg together define a space between them in which a roofing shingle can be inserted such that the leg and the hook will engage opposite surfaces of the roofing shingle;

a light holding portion comprising a U-shaped body;

a hinge connecting the U-shaped body to the corner;

a first locking tab and a second locking tab, the first locking tab attached to the arm adjacent the corner and the second locking tab is attached to the middle portion adjacent the corner such that a center line through the first locking tab will intersect a center line through the second locking a substantially right angle;

a first retainer tab attached to the light holding portion and being configured and positioned to engage the first locking tab when the light holding portion is in a first position; and a second retainer tab attached to the light holding portion and being configured and positioned to engage the second locking tab when the light holding portion is in a second position.

14. The clip for holding decorative lights of claim 13 wherein the U-shaped body has in inner surface having two pairs of arcs, each pair of arcs defining an opening sized to receive a decorative light.

15. The clip for holding decorative lights of claim 14 also comprising at least one tooth on the inner surface of the U-shaped body.

16. The clip for holding decorative lights of claim 13 also comprising a pair of wings, one wing extending from each side of the corner.

17. The clip for holding decorative lights of claim 13 wherein the second hook is offset from a center line through the middle portion.

18. The clip for holding decorative lights of claim 13 wherein the U-shaped body has an inner surface having opposite sides and a base that extends between the sides, the sides defining an opening sized to receive a decorative light and further comprising a U-shaped holder sized to hold a mini-light and attached to the base.

19. The clip for holding decorative lights of claim 18 further comprising a plurality of teeth on the inner surface, the teeth defining an opening sized to receive and grip a socket of a C-7 decorative light bulb, a socket of a C-9 decorative light bulb or a socket of an LED decorative light bulb.

20. The clip for holding decorative lights of claim 13 wherein the leg has a concave exterior surface between the tapered end and the second end.

21. The clip for holding decorative lights of claim 1 wherein the middle portion has a first side and a second side opposite the first side, the second hook being attached to the middle portion adjacent the first side and further comprising a stabilizer attached to and extending form the second side.

22. A clip for holding decorative lights on a gutter and for holding decorative lights on shingles comprised of:

a leg tapered at one end and having a second end;

a middle portion having a first end and a second end, the second end of the middle portion connected to the second end of the leg such that the middle portion and the leg are substantially perpendicular to one another;

an arm having a first end connected to the first end of the middle portion at a corner such that a portion of the arm adjacent the middle portion and the middle portion are substantially perpendicular to one another, the arm having a second end with a hook at the second end, the hook having a distal end and defining a space of sufficient size to receive a rope light; wherein the arm and the hook are sized and configured so that the hook will be adjacent the leg and the hook and leg together define a space between them in which a roofing shingle can be inserted such that the leg and the hook will engage opposite surfaces of the roofing shingle; and a second hook attached to the middle portion and sized to receive a rope light the second hook being offset from a center line through the middle portion.

23. A clip for holding decorative lights on a gutter and for holding decorative lights on shingles comprised of:

a leg tapered at one end and having a second end;

a middle portion having a first end and a second end, the second end of the middle portion connected to the second end of the leg such that the middle portion and the leg are substantially perpendicular to one another;

an arm having a first end connected to the first end of the middle portion at a corner such that a portion of the arm adjacent the middle portion and the middle portion are substantially perpendicular to one another, the arm having a second end with a hook at the second end, the hook having a distal end and defining a space of sufficient size to receive a rope light; wherein the arm and the hook are sized and configured so that the hook will be adjacent the leg and the hook and leg together define a space between them in which a roofing shingle can be inserted such that the leg and the hook will engage opposite surfaces of the roofing shingle;

a second hook attached to the middle portion and sized to receive a rope light; and a pair of wings, one wing extending from each side of the corner.

* * * * *